US006364632B1

(12) United States Patent
Cromm et al.

(10) Patent No.: US 6,364,632 B1
(45) Date of Patent: Apr. 2, 2002

(54) COMPRESSOR

(75) Inventors: Gerd W. Cromm, Dortmund; Peter Lohrmann, Hiddenhausen, both of (DE)

(73) Assignee: BOGE Kompressoren Otto Boge GmbH & Co. KG, Bielefeld (DE)

( * ) Notice: Subject to any disclaimer, the term of this patent is extended or adjusted under 35 U.S.C. 154(b) by 0 days.

(21) Appl. No.: 09/512,176

(22) Filed: Feb. 24, 2000

(30) Foreign Application Priority Data

Feb. 26, 1999 (DE) ..... 199 08 308

(51) Int. Cl.[7] ..... F04B 39/06; F04B 35/04
(52) U.S. Cl. ..... 417/372; 417/415
(58) Field of Search ..... 417/372, 415, 417/312

(56) References Cited

U.S. PATENT DOCUMENTS 1,622,876 A * 3/1927 Leo ..... 417/415
1,738,104 A * 12/1929 Hall ..... 417/415
1,791,672 A 2/1931 Hinckley
2,019,689 A * 11/1935 Marbury ..... 417/372
2,236,244 A * 3/1941 Cornelius ..... 417/372
3,372,863 A * 3/1968 Bloom ..... 417/372
3,462,075 A 8/1969 Dirk et al.
3,478,958 A * 11/1969 Hinck, III et al. ..... 417/312
4,190,402 A * 2/1980 Meece et al. ..... 417/415
4,492,533 A 1/1985 Tsuge
4,784,585 A * 11/1988 Hata et al. ..... 417/372
5,322,419 A * 6/1994 Novalan et al. ..... 417/372

FOREIGN PATENT DOCUMENTS

| | | |
|---|---|---|
| DE | 881 971 | 7/1953 |
| DE | 1 996 999 | 6/1964 |
| DE | 19 16 857 | 10/1970 |
| DE | 2 030 047 | 3/1971 |
| DE | 238 645 | 8/1986 |
| GB | 1 454 140 | 10/1976 |
| GB | 2 096 711 | 10/1982 |

* cited by examiner

*Primary Examiner*—Michael Koczo
(74) *Attorney, Agent, or Firm*—Technoprop Colton LLC

(57) ABSTRACT

Compressors with two cylinders in a horizontally opposed arrangement are known. The compressor according to the invention has a vertically aligned crankshaft. The electric drive motor is arranged underneath the cylinders and provided with a radial fan. The cooling air flows upwards along the drive motor and along the cylinders.

17 Claims, 4 Drawing Sheets

COMPRESSOR

BACKGROUND OF THE INVENTION

1. Technical Field

The invention relates to a compressor with one or more cylinders arranged horizontally and with a crankshaft in a crankcase.

2. Prior Art

U.S. Pat. No. 1,791,672 has disclosed a compressor for producing compressed air with two cylinders in a horizontally opposed arrangement. A common crankshaft mounted in a crankcase is driven by an electric motor. The electric motor and the cylinders lie in the same horizontal plane. On its underside, the electric motor is mounted on a foundation or bolted to the latter. The surface area required for the arrangement is relatively large.

BRIEF SUMMARY OF THE INVENTION

It is the object of the present invention to provide a compressor of as compact construction as possible.

The compressor according to the invention is characterized in that the crankshaft is aligned vertically, in that a drive assembly coupled to the crankshaft is arranged underneath the at least one cylinder, in that a fan coupled to the drive assembly or to the crankshaft is provided, and in that the fan produces an air flow which is guided upwards along the drive assembly and along the at least one cylinder.

In contrast to the prior art described above, the drive assembly, preferably an electric motor, is arranged underneath the cylinders. This results in a significantly reduced surface-area requirement. In addition, the ventilation and cooling of both assemblies can be performed by a common flow of air.

The vertical arrangement according to the invention, with the cylinders and the drive assembly one above the other, preferably has two cylinders in a horizontally opposed arrangement. Embodiments with just one cylinder or with a plurality of cylinders in a different arrangement, for instance a star or V arrangement, are also possible, however. In all cases, the cylinders are provided transversely to the vertical crankshaft or drive shaft.

It is advantageous if the drive assembly is coupled to the crankshaft in the manner of a direct drive. However, an indirect drive via a gearbox is also possible.

A fan for producing a flow of air is arranged underneath the cylinders and, in particular, underneath the drive assembly. The fan is preferably designed as a radial fan, the air which flows in axially in a region of the fan away from the cylinders flowing out in the radial direction and brushing upwards laterally along the drive assembly and/or along the cylinders. An upward flow of air is produced for the cooling air and the intake air. The drive assembly and the cylinders are provided with cooling ribs. The upward-flowing air brushes past these and produces effective cooling. Thanks to the compact construction of modern electric motors, the cylinders project laterally and lie precisely in the flow of cooling air.

A (first) intake filter, preferably a filter mat, is provided in the region where the air enters the fan. This mat lies close to an inlet opening of an inlet housing arranged ahead of the fan.

The cylinders are assigned a (second) air filter, in particular an air filter common to a plurality of cylinders. The air filter is provided above the cylinders, in particular centrally. Air inlet openings of the air filter are situated in the region of the upward-flowing air mentioned above.

The air filter has an intake regulator, allowing output to all the cylinders connected to be interrupted quickly and thus allowing the operation of the compressor to be adapted to a lower compressed-air requirement.

By suitable guidance of the intake air (of the air to be compressed), it is possible to avoid feeding warm air into the air filter. It is advantageous if the intake air is guided from an intake opening underneath the cylinders to the air filter arranged above the cylinders. The intake-air guide is a tube of appropriate cross section. The intake opening is at a sufficient distance from heat-radiating surfaces, in particular cooling ribs. The actual distance will depend on the specific temperature and flow conditions.

It is advantageous if the upward flow of air is guided along the cylinders and along the crankcase and/or along the drive assembly by air guide members. This makes it possible to achieve more rapid heat dissipation.

The air guide members are decoupled from the cylinders in terms of vibration.

The compressor assembly—the cylinders, the crankcase and the drive assembly—is mounted in a housing. The air guide members are associated with the housing, while the compressor assembly is mounted in the housing in such a way that it can oscillate.

The air to be compressed is fed to the cylinders on their upper sides and removed from them as compressed air on the undersides. Corresponding compressed-air lines run in a plane underneath the cylinders and lie in the upward flow of air.

The cylinders are connected to one another by a common compressed-air line. This compressed-air line continues from one of the cylinders and is passed around the crankcase in the same horizontal plane, in particular through 180° or more. At the same time, the encircling compressed-air line is at an adequate distance from the crankcase, thus ensuring that the heat of the lines is dissipated by rising air which is as cool as possible.

It is advantageous if the air filter arranged close to the cylinders has thermally insulated walls, in particular an insulating base plate. This avoids heating of the incoming air by the air-filter housing.

The drive assembly and the cylinders form a unit in terms of vibration. The resonant frequency is correspondingly low. This is additionally lowered by further measures. The unit is, for instance, mounted at a relatively low level. This purpose is served by supporting arms, the free ends of which are mounted on the housing at mounting points at a level below a transition between the cylinders and the drive assembly. At the end adjoining the unit, the supporting arms engage between the crankcase and the drive assembly, for instance. The free ends of the supporting arms rest on damping elements, These are arranged on the housing at the level of the centre of gravity of the unit capable of oscillation, on corresponding supporting beams or ties.

The supporting arms provide a star-shaped mounting for the unit in the housing. In this arrangement, the crankcase is at the centre of the mounting points.

Finally, the cylinders are assigned additional weights, advantageously radially to the outside of the cylinders with respect to the rotation of the crankshaft. The additional weights make it possible to increase the mass moment of inertia about the centre of gravity of the unit and thus, in particular, make it possible to counteract the formation of torsional vibrations.

Further features of the invention will become apparent from the claims. Overall, all the features disclosed are essential to the invention, both individually and in combination with others.

Advantageous embodiments of the invention will be explained in greater detail below with reference to drawings, in which;

DETAILED DESCRIPTION OF THE PREFERRED EMBODIMENTS

Figure 3:
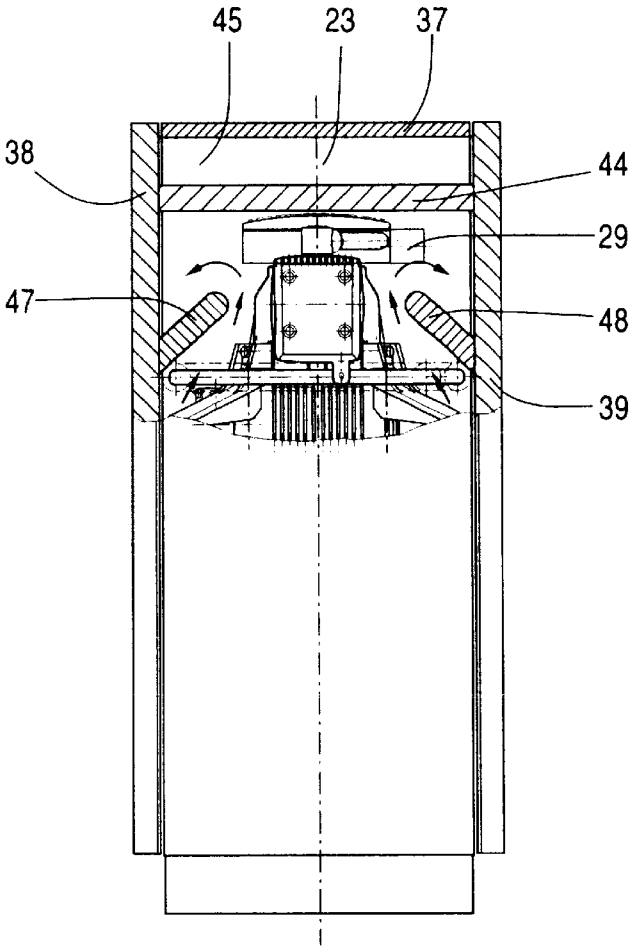
FIG. 3 shows a side view offset by 90° relative to FIG. 2.
Figure 2:
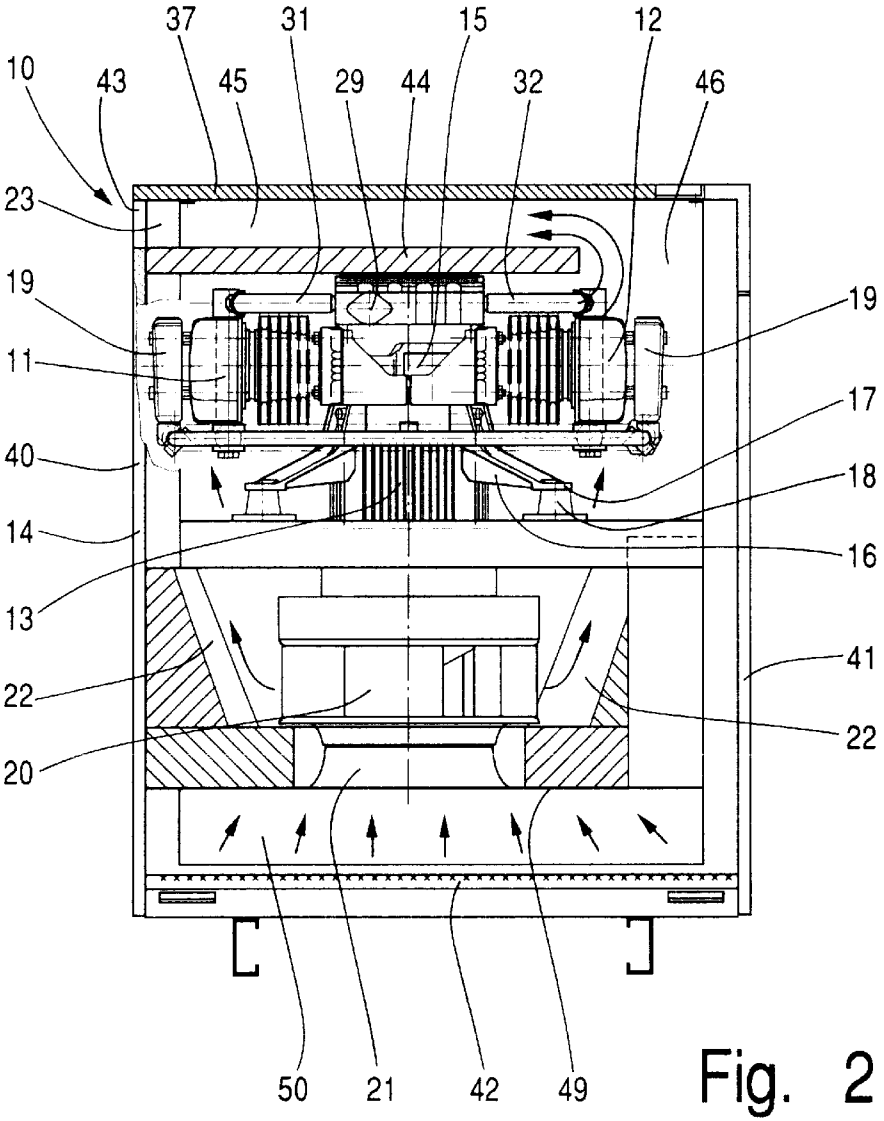
FIG. 2 shows a partially sectioned side view of a compressor with a housing.

A piston-type compressor 10 with two cylinders 11, 12 in a horizontally opposed arrangement is arranged in an enclosed manner in a housing 14 together with an electric drive motor 13, cf. FIGS. 2 and 3. Underneath a crankcase 15, the motor 13 is connected to the latter. The drive shaft (not shown) and the crankshaft (likewise not shown) of the compressor are coupled directly and are thus aligned vertically. The crankcase 15 is also referred to as a cylinder bracket and accommodates a piston arrangement which operates in an oil-free manner and has two pistons (likewise not shown).

The drive motor 13 is mounted in a suspended manner. For this purpose, supporting arms 16 aligned radially (in a star shape) engage in the region of the transition between the motor 13 and the crankcase 15. Free ends 17 of the supporting arms rest on damping elements 16. These can have a rubber pad or the like and are firmly connected to parts of the housing. This allows the unit comprising cylinders 11, 12 and motor 13 to oscillate relative to the housing 14. The free ends 17 are approximately halfway up the drive motor 13. A relatively low resonant frequency is thereby achieved.

The resonant frequency is furthermore lowered by means of additional weights 19. One weight is assigned to each cylinder and is seated in front of its end. As a result, the additional weights 19 are at the maximum distance from the centre of gravity and increase the mass moment of inertia about the common centre of gravity. The connection between the cylinders 11, 12 and the additional weights 19 can, for example, be made by means of extended cylinder stud bolts or bolts arranged parallel thereto.

Adjoining the drive motor 13 at the bottom is a radial fan 20, which rotates with the drive shaft (not shown). The air is fed to the radial fan 20 axially from below via a nozzle 21. This is associated with the housing 14, while the radial fan is connected to the drive motor 13. The nozzle 21 and the radial fan 20 are accordingly separated from one another in terms of vibration.

The air emerging radially from the radial fan 20 is guided upwards by an air guide apparatus arranged in the housing, in particular bottom air baffles 22, and cools the drive motor 13, the cylinders 11, 12, the crankcase 15 and other components subjected to heat. Finally, the heated air emerges from the housing 14 in an upper region, cf. air outlet 23 in FIGS. 2 and 3.

Figure 1:
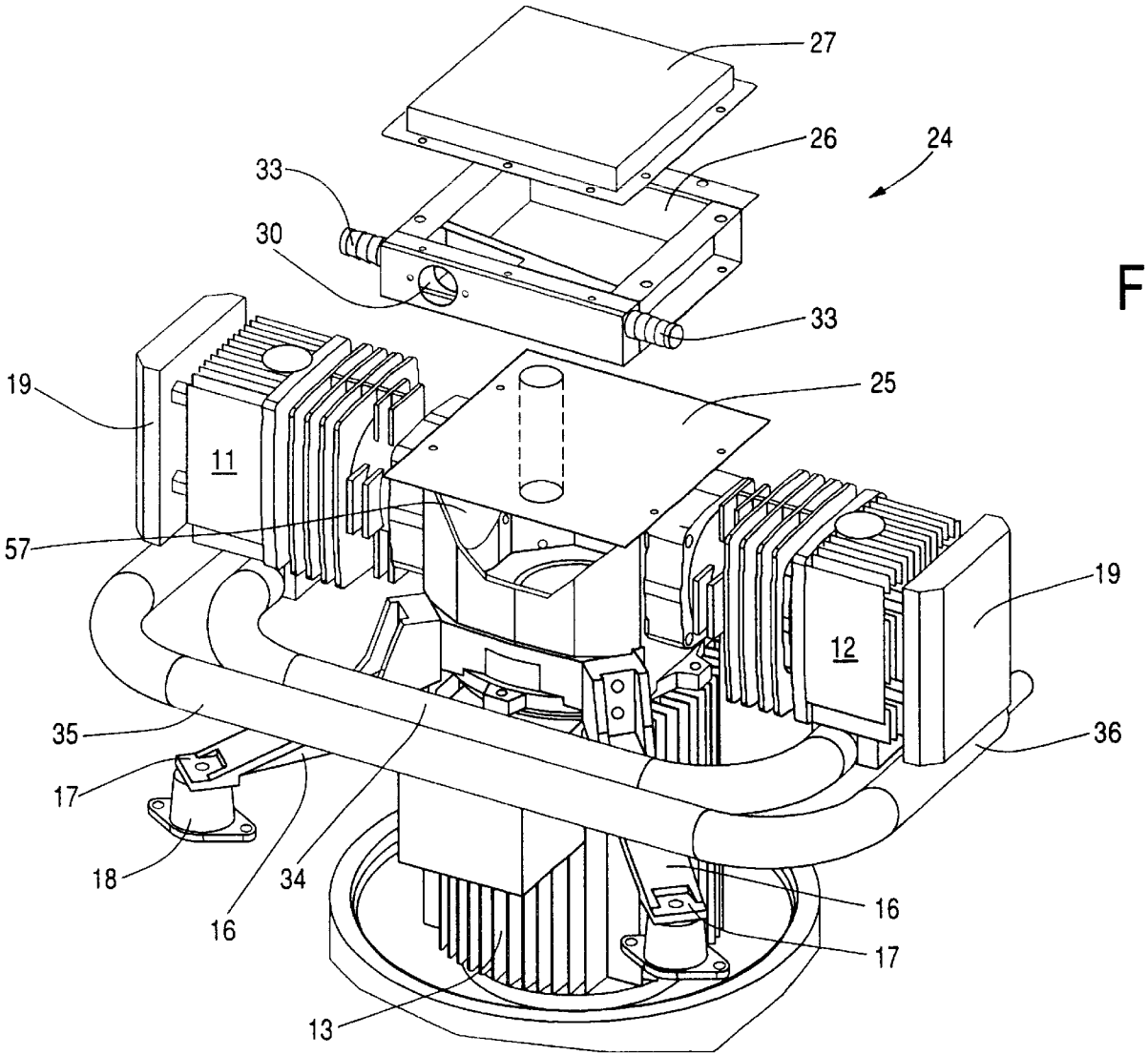
FIG. 1 shows a perspective representation of a compressor assembly with cylinders and a drive motor.

Some of the upward-directed air is fed as intake air to an air filter 24. This is designed as a flat rectangular housing and is arranged on top of the crankcase 15. FIG. 1 shows an exploded representation of the air filter 24. It shows a base plate 25, a frame 26 and a top cover 27.

Figure 5:
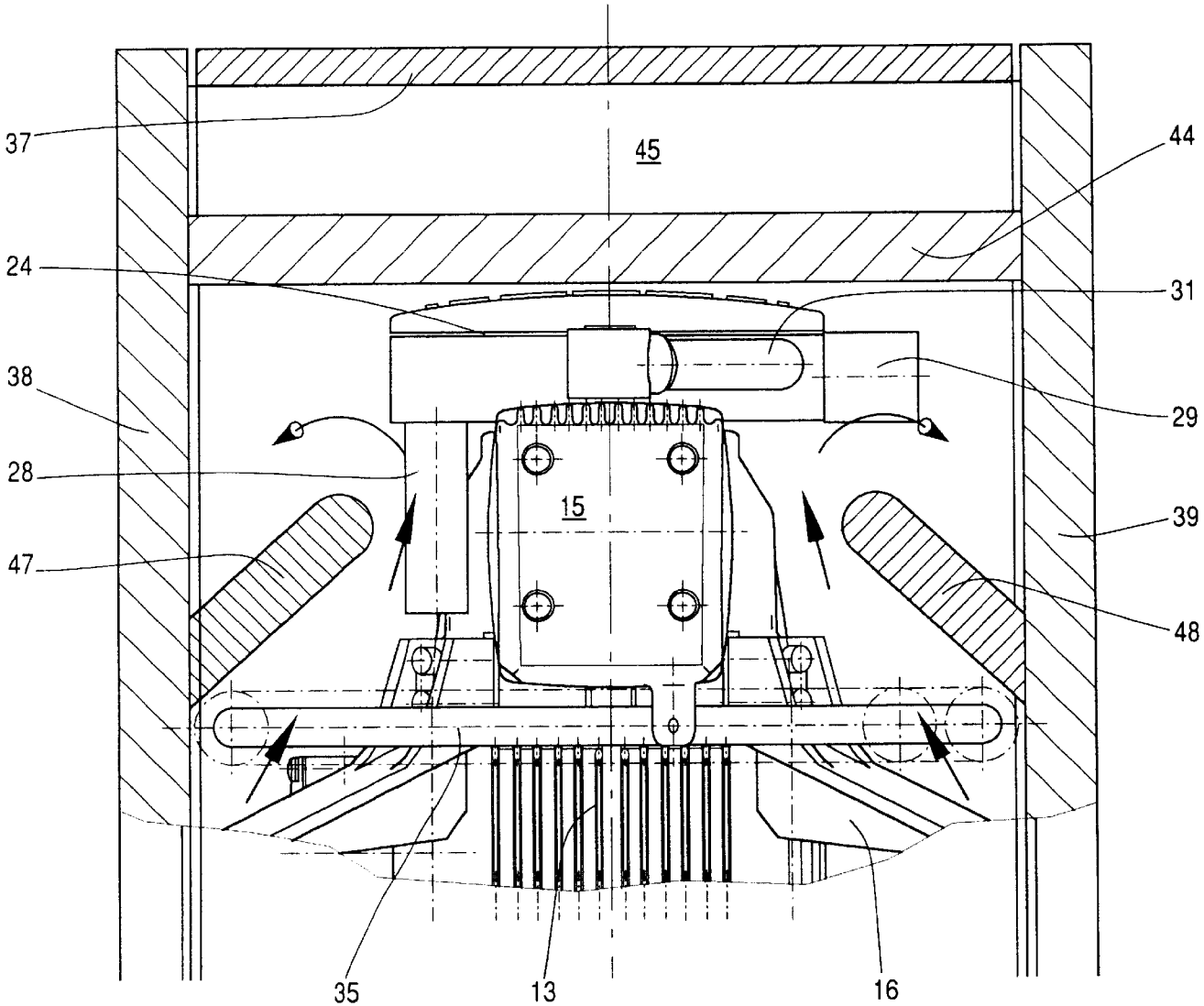
FIG. 5 shows an enlarged representation corresponding to FIG. 3 with a detail not shown there.

The air flows into the air filter via a downward-pointing intake pipe 28 on the base plate 25, cf., in particular, FIG. 5. The intake pipe 28 extends over more than ⅔ of the height of the crankcase 15. As a result, the air heated by the crankcase does not enter the air filter 24.

The base plate 25 and, if appropriate, other components of the air filter 24 are of thermally insulating design, thus ensuring that excessive heating of the intake air cannot occur by heat conduction either.

The air filter 24 is provided with a regulator 29 common to both cylinders 11, 12, cf. FIG. 5. In FIG. 1, only a cut-out in the frame 26 for the regulator 29 is visible. By means of the regulator 29, extremely quick regulation of the compressed-air output is possible. It is the amount of air released to the cylinders 11, 12 which is regulated. The intake air is fed to the two cylinders 11, 12 via corresponding intake lines 31, 32 from the air filter 24, cf. FIG. 2. For this purpose, the air filter 24 has corresponding connection stubs 33.

The compressed air produced is guided in a special way in the housing 14. The two cylinders are connected to one another by a compressed-air line 34 extending below them in a horizontal plane, cf. FIG. 1. The compressed-air line 34 begins at cylinder 11 and continues beyond cylinder 12 (specifically underneath the same) and is passed once around the crankcase, always in the same horizontal plane. In FIG. 1, that part of the compressed-air line which is continued beyond cylinder 12 is concealed and only that part (compressed-air line 35) which runs parallel to the compressed-air line 34 is visible. Its end piece 36 lies approximately underneath cylinder 12. The outlet for the compressed air from the housing is not shown. At all events, the compressed air is guided through about 360° around the crankcase after emerging from cylinder 12, being guided in a horizontal plane and hence through the upward flow of cooling air. If the compressed-air line 34 connecting the cylinders 11, 12 is included, the angle obtained is as much as 540°. By virtue of the distance of the compressed-air lines 34, 35 from the crankcase and from the motor 13, these do not heat up the lines 34, 35.

The housing 14 with cover plate 37, large side walls 38, 39 and narrow side walls 40, 41 encloses the compressor 10 in terms of noise emissions and dust. An open underside is covered by a large filter mat 42 and thus serves as an air inlet. The filter mat 42 is held in lateral guide rails. The formation of dust within the housing is thereby avoided. Different air filters can also be used instead of the filter mat 42.

The cooling air emerges in the region of the narrow side wall 40. For this purpose, the latter has, close to the cover plate 37, an opening 43 which extends over the entire width of the side wall 40. Arranged in the housing 14 as a lower limit to the opening 43 and of the air outlet 23 is a horizontal wall 44 which, starting from the side wall 40, extends over about ¾ of the width of the side wall 39 and thus forms an exhaust-air duct 45, which has a downward-facing opening close to the side wall 41.

Air guide members 47, 48, in particular air baffles, are arranged on the large side walls 38, 39, These baffles extend over the width of the large side walls 38, 39 and point obliquely upwards close to the cylinders 11, 12 and above the compressed-air lines 34, 35. As a result, the upward-flowing cooling air is guided close to the crankcase 15 and the speed of flow is increased in this region. This ensures efficient cooling. The intake pipe 28 extends precisely in the narrowest region between air guide member 47 and crankcase 15.

The nozzle 21 is inserted into a partition 49. This lies parallel to the underside and thus forms an intake chamber 50 for the nozzle 21. Insulating material is preferably applied to the partition. This material is indicated by hatching in FIG. 2 and is otherwise not shown specifically.

Figure 4:
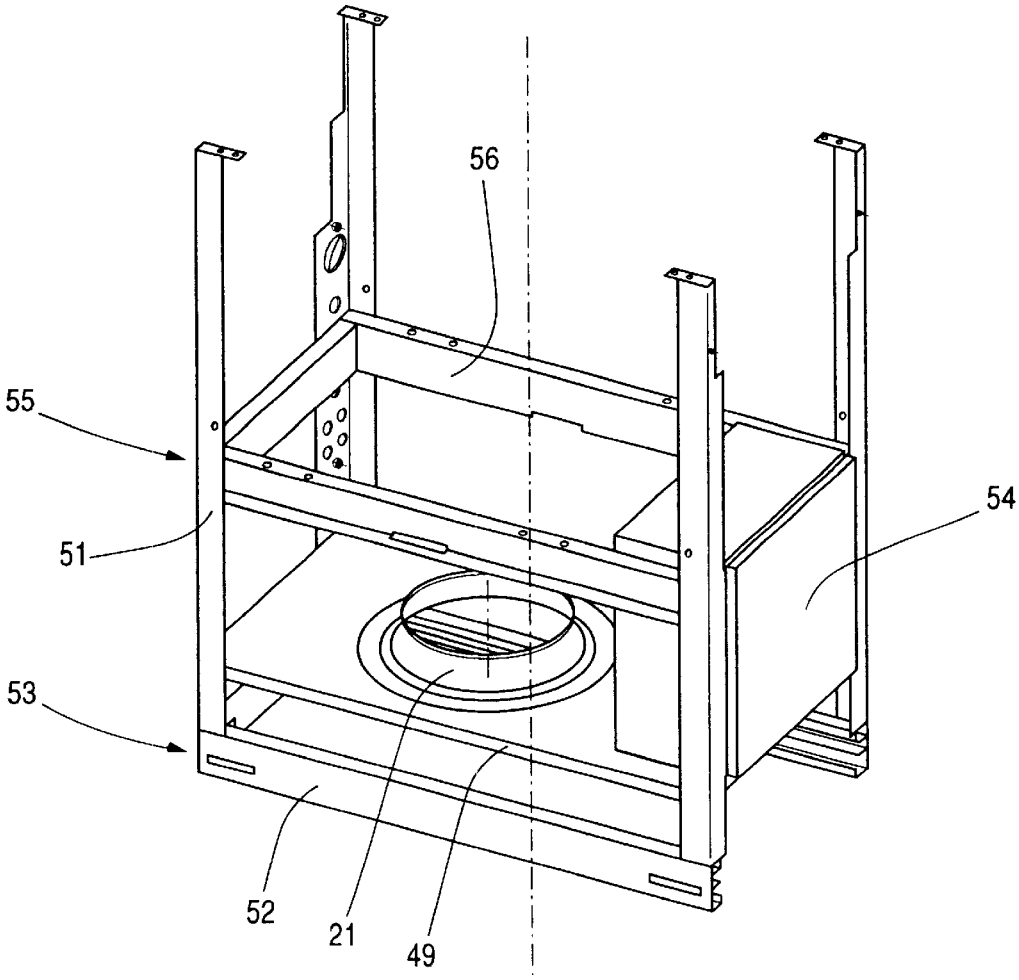
FIG. 4 shows a perspective representation of a supporting stand for holding the compressor assembly.

The housing 14 is constructed as a framework, as can be seen in FIG. 4. Outer, upright struts 51 rest on cross-ties 52 of a subframe 53. The partition 49 is inserted above the subframe 53 and at a distance from the latter. A switch box 54 is arranged on a narrow side wall 41, above the partition 49, Approximately halfway up the struts 51, a centre frame 55 with corresponding cross-ties 56 is connected to the upright struts 51. The damping elements 19 are held on the cross-ties 56. The compressor assembly is accordingly mounted on the centre frame 55 in a manner which allows it to oscillate.

The cover plate 37 and the wall 44 parallel to it are not shown in FIG. 4.

The compressor 10 described can be varied in numerous different ways. Thus different cylinder arrangements can be provided, e.g. 2×2 cylinders each in a horizontally opposed arrangement, with an offset of 90° relative to one another, or a multi-stage arrangement in which the compressed air emerging from one cylinder is drawn in by the next cylinder and compressed further. Oil-lubricated piston/cylinder arrangements can also be installed. The crankcase 15 can then be fully enclosed. In the present embodiment, the crankcase has respective V-shaped openings 57 between the cylinders, on the free sides (at the top edge), the rear opening being concealed in FIG. 1. This allows cooling air to enter the crankcase. This process is assisted by the configuration and arrangement of the air guide members 47.

Finally, attention is also drawn to the guidance of the air within the housing 14. Arrows without numbers are depicted in FIGS. 2, 3 and 5 to represent the air flows. The housing or housing walls forms/form an outer guide for the flow of cooling air.

What is claimed is:

1. Compressor with at least one cylinder (11, 12) arranged in a linear arrangement with a crankcase (15) containing a crankshaft, characterized in that:

the crankshaft is aligned normal to and downward relative to the surface of the earth from the linear arrangement, a drive assembly (13) is coupled to the crankshaft and is attached to a side of the crankcase (15) normal to and downward relative to the surface of the earth from the linear arrangement, the crankshaft extending vertically between the drive assembly (13) and the crankcase;

the at least one cylinder (11, 12) comprises an air intake that intakes air from a region proximal to the side of the crankcase (15) on which the drive assembly (13) is attached, and feeds the air into at least one air filter (24);

an air guide member (47, 48) that guides the intake air from an intake opening proximal to the at least one cylinder (11, 12) and the side of the crankcase (15) on which the drive assembly (13) is attached to the at least one air filter (24), which is arranged on a side of the crankcase (15) opposite to the side of the crankcase (15) on which the drive assembly (13) is attached; and a fan (20) is coupled to the drive assembly (13), wherein the fan (20) produces an air flow that is guided along the drive assembly (13) and along the at least one cylinder (11, 12).

2. Compressor according to claim 1, characterized in that the fan (20) is designed as a radial fan, having outflowing air flowing laterally along the drive assembly (13) and along the at least one cylinder (11, 12).

3. If Compressor according to claim 2, characterized in that the at least one cylinder (11, 12) comprises an air intake that intakes air from a region proximal to the side of the crankcase (15) on which the drive assembly (13) is attached and feeds the air to at least one air filter (24).

4. Compressor according to claim 1, characterized in that the airflow is a flow of cooling air guided along the at least one cylinder (11, 12) and along the crankcase (15) by the at least one air guide member (47, 48).

5. Compressor according to claim 4, characterized in that the compressor is mounted within a housing comprising housing walls (38, 39), and the at least one air guide member (47, 48) is mounted on the housing walls (38, 39), the housing walls (38, 39) being decoupled from the at least one cylinder (11, 12) from vibration.

6. Compressor according to claim 1, characterized in that compressed air emerging from the at least one cylinder (11, 12) is carried in lines (34, 35) which are exposed to a flow of cooling air from the fan.

7. Compressor according to claim 6, characterized in that the lines (34, 35) are arranged in a plane transverse to the flow of air.

8. Compressor according to claim 6 characterized in that, after emerging from the at least one cylinder (11, 12), the lines (34, 35) are passed at least once around the crankcase (15), below relative to the surface of the earth the at least one cylinder, proximal to the side of the crankcase (15) on which the drive assembly (13) is attached.

9. Compressor according to claims 6 characterized in that the compressor is a compressed air compressor, the compressor comprises a plurality of cylinders (11, 12), and the plurality cylinders (11, 12) are connected to one another on a compressed-air side by a common connecting compressed-air line (34).

10. Compressor according to claim 9, characterized in that a compressed-air outlet line (35) common to the plurality of cylinders is connected to the common connecting compressed-air line (34).

11. Compressor according to claim 7, characterized in that, after emerging from the at least one cylinder (11, 12), the lines (34, 35) are passed at least once around the crankcase (15), below the at least one cylinder, proximal to a side of the crankcase (15) on which the drive assembly (13) is attached.

12. Compressor according to claim 1, characterized in that the drive assembly (13) is a drive motor, which is coupled to the at least one cylinder (11, 12) to form a unit, the at least one cylinder (11, 12) is mounted in a star shape with projecting supporting arms (16) comprising free ends (17), and in that, to lower a resonant frequency, the free ends (17) of the supporting arms (16) are mounted at mounting points at a level below relative to the surface of the earth a transition between the at least one cylinder (11, 12) and the drive motor.

13. Compressor according to claim 1, characterized in that the at least one cylinder (11, 12) further comprises weights (19), which, with respect to the rotation of the crankshaft, are arranged on a radially outward side of the at least one cylinder (11, 12).

14. Compressor comprising:

a plurality of cylinders (11, 12) and a crankcase (15) arranged linearly defining a horizontal plane relative to the surface of the earth, wherein the crankcase (15) comprises a top side, a bottom side, and a crankshaft, the crankshaft being arranged normal to and downward from the horizontal plane and defining a vertical plane;

a drive assembly (13) that comprises a top side and a bottom side, the drive assembly (13) located proximal to the bottom side of the crankcase (15) and being coupled to the crankshaft;

a fan (20) located proximal to the bottom side of the drive assembly (13) and being coupled to the drive assembly (13) and said crankshaft;

a housing (14) having an upper region that comprises an air outlet (23) and a lower region that comprises an air inlet having an air filter, wherein the housing (14) contains the plurality of cylinders, the crankcase, the fan (20) and a fan motor;

a partition (49) in the housing (14), the partition (49) being located proximal to the lower region of the housing (14);

an intake chamber (5) being formed between the partition (49) and the lower region of the housing (14); and a nozzle (21) provided at a location opposite the bottom side of the drive assembly (13), defined as under the fan (20), for guiding the air entering the fan (20), the nozzle (21) being inserted into the partition (49) of the housing (14), wherein the fan (20) generates an airflow guided upwards along the drive assembly (13) and along at the plurality of cylinders (11, 12).

15. Compressor according to claim 14, wherein:

the fan (20) is a radial fan that draws in air axially from a location opposite the bottom side of the drive assembly (13); and the fan (20) delivers the air in a radial direction; and further comprising an air guide member to direct air in a radial direction from the fan (20) upwards towards the drive assembly (13).

16. Compressor according to claim 14, characterized in that the compressor operates oil-free.

17. Compressor according to claim 14, wherein the airflow guided upwards along the drive assembly and along at the plurality of cylinders (11, 12) is drawn in a region at a distance from the plurality of cylinders (11, 12) and through at least one air filter (24).

* * * * *